US006763819B2

(12) United States Patent
Eckert

(10) Patent No.: US 6,763,819 B2
(45) Date of Patent: Jul. 20, 2004

(54) BOW STRING RELEASE

(75) Inventor: Jeffrey A Eckert, North Fond du Lac, WI (US)

(73) Assignee: Tru-Fire Corporation, North Fond du Lac, WI (US)

( * ) Notice: Subject to any disclaimer, the term of this patent is extended or adjusted under 35 U.S.C. 154(b) by 0 days.

(21) Appl. No.: 09/882,276

(22) Filed: Jun. 15, 2001

(65) Prior Publication Data

US 2003/0089360 A1 May 15, 2003

(51) Int. Cl.[7] ..... F41B 5/18
(52) U.S. Cl. ..... 124/35.2
(58) Field of Search ..... 124/35.2

(56) References Cited

U.S. PATENT DOCUMENTS

| | | | |
|---|---|---|---|
| 228,302 | A | 6/1880 | Beard |
| 750,988 | A | 2/1904 | Lotz |
| 1,542,159 | A | 6/1925 | Maxwell |
| 2,000,015 | A | 5/1935 | Flury |
| 2,488,597 | A | 11/1949 | Konold |
| 2,819,707 | A | 1/1958 | Kayfes et al. |
| 2,936,749 | A | 5/1960 | Chellstorp |
| 3,672,346 | A | 6/1972 | Plumb |
| 3,948,243 | A | 4/1976 | Gazzara, Sr. |
| 4,036,204 | A | 7/1977 | Scott |
| 4,041,926 | A | 8/1977 | Troncoso, Jr. et al. |
| 4,151,825 | A | 5/1979 | Cook |
| 4,160,437 | A | 7/1979 | Fletcher |
| 4,257,386 | A | 3/1981 | Gazzara |
| 4,282,851 | A | 8/1981 | Lyons |
| 4,403,594 | A | 9/1983 | Todd |
| 4,407,260 | A | 10/1983 | Lyons |
| 4,527,536 | A | 7/1985 | Smith |
| 4,567,875 | A | 2/1986 | Fletcher |
| 4,574,767 | A | 3/1986 | Gazzara |
| 4,620,523 | A | 11/1986 | Peck |
| 4,674,469 | A | 6/1987 | Peck |
| 4,691,683 | A | 9/1987 | Peck |
| 4,722,319 | A | 2/1988 | Brady |
| 4,860,720 | A | 8/1989 | Todd |
| 4,881,516 | A | 11/1989 | Peck |
| 4,909,232 | A | 3/1990 | Carella |
| 4,926,835 | A | 5/1990 | Peck |
| 4,981,128 | A | 1/1991 | Garvison |
| 5,027,786 | A | 7/1991 | Peck |
| 5,067,472 | A | 11/1991 | Vogel et al. |
| 5,070,854 | A | 12/1991 | Peck |
| 5,076,251 | A | 12/1991 | Peck |
| 5,078,116 | A | 1/1992 | Peck |
| 5,103,796 | A | 4/1992 | Peck |
| 5,170,771 | A | 12/1992 | Peck |
| 5,263,466 | A | 11/1993 | Peck |
| 5,307,788 | A | 5/1994 | Peck |
| 5,318,004 | A | 6/1994 | Peck |

(List continued on next page.)

OTHER PUBLICATIONS

TRU Ball Release Products catalog (not dated).
TRU Ball Release Products catalog, 1997, page 4.
TRU Ball Release Products catalog, (not dated).
HHA Sports 1997 Archery catalog.

*Primary Examiner*—John A. Ricci
(74) *Attorney, Agent, or Firm*—Gerald E. Helget; Briggs & Morgan, P.A.

(57) ABSTRACT

A bow string release for engaging and releasing a bow string, comprising opposing jaws, a trigger, a housing, a jaw roller and a plurality of pins, the opposing jaws and the trigger coupled to the housing by pins, and the jaw roller coupled to the trigger and allowing the opposing jaws to an open condition when the trigger is in a pulled position. The bow string release of the present invention is adapted to minimize "loading up" of trigger force required to pull the trigger at full draw of a bow. Further the bow string release of the present invention is adapted to release the bow string at a trigger pull force of equal to or less than 9 ounces when an effective draw weight of the bow is equal to or more than 15 pounds.

30 Claims, 4 Drawing Sheets

U.S. PATENT DOCUMENTS

| | | | | |
|---|---|---|---|---|
| 5,357,939 | A | | 10/1994 | Tentler et al. |
| 5,359,983 | A | | 11/1994 | Peck |
| 5,370,102 | A | | 12/1994 | Peck |
| 5,417,197 | A | | 5/1995 | Bankstahl |
| 5,448,983 | A | | 9/1995 | Scott |
| 5,558,077 | A | | 9/1996 | Linsmeyer |
| 5,564,407 | A | | 10/1996 | Linsmeyer |
| 5,582,158 | A | | 12/1996 | Linsmeyer |
| 5,595,167 | A | | 1/1997 | Scott |
| 5,596,977 | A | | 1/1997 | Scott |
| 5,615,662 | A | | 4/1997 | Tentler et al. |
| 5,653,213 | A | | 8/1997 | Linsmeyer |
| 5,680,851 | A | | 10/1997 | Summers |
| 5,680,852 | A | | 10/1997 | Tentler et al. |
| 5,685,286 | A | | 11/1997 | Summers |
| 5,715,805 | A | | 2/1998 | Summers et al. |
| 5,765,536 | A | | 6/1998 | Scott |
| 5,803,068 | A | | 9/1998 | Summers |
| 5,850,825 | A | | 12/1998 | Scott |
| 5,850,827 | A | | 12/1998 | Peck |
| 5,904,135 | A | | 5/1999 | Summers et al. |
| 5,937,842 | A | | 8/1999 | Summers et al. |
| 5,941,225 | A | | 8/1999 | Tentler et al. |
| 6,032,661 | A | | 3/2000 | Goff et al. |
| 6,058,919 | A | | 5/2000 | Davis |
| 6,058,920 | A | * | 5/2000 | Tentler ..... 124/35.2 |
| 6,173,706 | B1 | | 1/2001 | McConnell |
| 6,173,707 | B1 | | 1/2001 | Howell et al. |
| 6,205,991 | B1 | | 3/2001 | Summers et al. |
| 6,213,113 | B1 | | 4/2001 | Groover et al. |
| 6,237,584 | B1 | | 5/2001 | Sims |
| 6,247,467 | B1 | | 6/2001 | Siegfried |
| 6,302,093 | B1 | | 10/2001 | Holland |

* cited by examiner

BOW STRING RELEASE

BACKGROUND OF THE INVENTION

1. Field of the Invention

The present invention is generally related to a bow string release and is specifically directed to a release head.

2. Description of the Prior Art

Mechanical archery bow string releases have become increasingly popular in recent years because they provide uniform control of the bow string and increase accuracy by effecting the consistent, controlled release of the arrow. Bow string releases are typically used to maintain the bow string in a cocked position in which the bow string is flexed against the tension of the bow for propelling the arrow supported on the bow string. When a drawn arrow is released from a release mechanism, the release is usually relatively rapid and at a point approximately in line with the centerline of the bow so that the bow string delivers most of its thrust directly along the major axis of the arrow. When tabs or fingers are used to release a bow string, the bow string tends to roll off the fingers or tab and be deflected sideways during release such that the bow string follows a serpentine path, failing to maximize energy delivery directly along the major axis of the arrow.

The arrow itself is generally comprised of a shaft with a point mounted on one end and a nock mounted on the opposite end. A standard arrow nock has a bow string receiving groove or notch defined by spaced apart legs extending from a base. The nock is configured to receive a bow string and insure stability of the arrow when the bowstring is drawn and released. When an arrow is loaded on a bow in this manner, the legs of the arrow nock extend beyond the bow string toward the archer such that and arrow can rotate about the bow string. When engaging the bow string, the nock is preferably seated at or near the mid-pint of the bow string to insure that the flight of the arrow is as true as possible.

The majority of the bow string releases have a body or casing which houses the sear and trigger mechanisms. The body is typically a cylindrical or rectangular design with the pivotable jaws of the sear mechanism positioned at one end and a trigger located along the length of the body. The release employs a trigger mechanism to activate the bow string retaining and release mechanism. The jaws and trigger mechanism of the bow string release are traditionally secured to the body with linkages or pins, which serve as a pivot mechanism for the jaws and trigger.

Recently, receivers for bow string releases have become increasingly popular. One example of such a receiver is disclosed in U.S. Pat. No. 5,850,827, assigned to Tru-Fire Corporation. When using a receiver, the archer attaches the bow string release directly to the receiver, instead of to the bow string. Instead of releasing the bow string, the release grasps and releases the receiver, which in turn allows the string to advance and propel the arrow forward.

Rope loops are also used in this capacity as a receiver. A short piece of rope, ordinarily approximately 2 mm in diameter, is attached to the bow string both above and below where the arrow nock rests. The perceived advantages of using a rope loop are varied. Once an archer employs a rope loop, the archer may find that it is difficult to engage the bow string release with the rope loop, due in part to the very resilient nature of rope.

Because of the difficulty in attaching bow string releases to rope loops, different bow string releases adapted to more easily grasp rope were introduced, including that disclosed in U.S. Pat. No. 5,680,851 to Summers, which is incorporated herein by reference. Other bow string releases adapted to more easily grasp rope include the Tru-Fire Corporation's "Tru-Caliper" line of releases.

Draw weight of a bow is ordinarily measured in pounds, and is the force required to pull back a bow string from a static position to a full draw position. Effective draw weight of the bow is the draw weight after let-off is factored. Effective draw weight is the force required to hold the bow string at full draw in the firing position. Common bows have draw weights of up to 100 pounds, and let-offs of up to 80%, decreasing the draw weight that the archer feels at full draw by the let off percentage.

It has been found that many commercial bow string releases, including a release referred to as a Tru-Ball "Tornado" release, "load up" severely as pulling force on the bow string is increased. "Loading up" is a phenomenon whereby the force required of the archer to pull the trigger and release the bow string increases as the effective draw weight of the bow increases. Thus, at higher effective draw weights, the archer must pull harder on the trigger, perhaps causing a decrease in sensitivity and performance. A harder trigger pull may also cause a jerking trigger release motion, causing erratic arrow flight.

There are two common trigger sensitivity adjustment mechanisms used widely. In one mechanism, the depth of engagement of sear elements is varied. This affects trigger pull length, also known as trigger travel distance, and indirectly affects pull force required by making the trigger travel farther to disengage the sear, which in turn increases the sliding friction. An example of this mechanism is U.S. Pat. No. 5,680,851 to Summers.

Another mechanism is a single roller on one sear element, sear element, typically mounted on one jaw, positioned in an angled slot in the other sear element, typically a slot in the trigger. Examples include a release known as the Scott Caliper release. In this mechanism, a roller is used to reduce friction between the sear elements. Adjustment is related to the positioning of a roller's center in relation to the edge of the angled slot. This limits the upper end range of trigger force required due to the rolling force in the slot. At the lower end of the pull force range, the roller center is balanced on or just outside the slot edge. If the roller center is outside the slot edge, the release will not stay closed during bow draw unless a force is applied to overcome the center over the edge condition created.

The only known release that changes the angle of contact between sear members and therefore permits incremental linear adjustments of trigger force is Tru-Fire's Classic Caliper as described in U.S. Pat. No. 5,582,158.

SUMMARY OF THE INVENTION

The present invention provides a bow string release mechanism that is easily attached to a bow string or a receiver. An archer's index finger pulls the bow string release of the present invention to open jaws on the release, and relaxes tension on the trigger to close the jaws. The jaws can be closed around a bow string, a receiver or the like. This convenient system allows the archer to maintain one finger on the trigger of the release to load the release onto the bowstring or receiver, and to relax the trigger to finalize loading by closing the jaws of the release.

The same trigger is used to release the bow string from full draw to propel the string and the arrow.

In one embodiment, the trigger is separated from the jaw to allow for smoother operation at all trigger sensitivity settings, particularly at fastest or lightest settings. In this embodiment, the trigger is not an integral sear element, and transmission of forces and slight movements are transferred to a roller axle linkage assembly from the jaws. This allows for reliable lower trigger settings.

It has been found that bow string releases according to the present invention advantageously minimize "loading up," thereby minimizing the force required of the archer to pull the trigger and release the bow string as the effective draw weight of the bow increases.

DETAILED DESCRIPTION OF THE PREFERRED EMBODIMENTS

Figure 1:
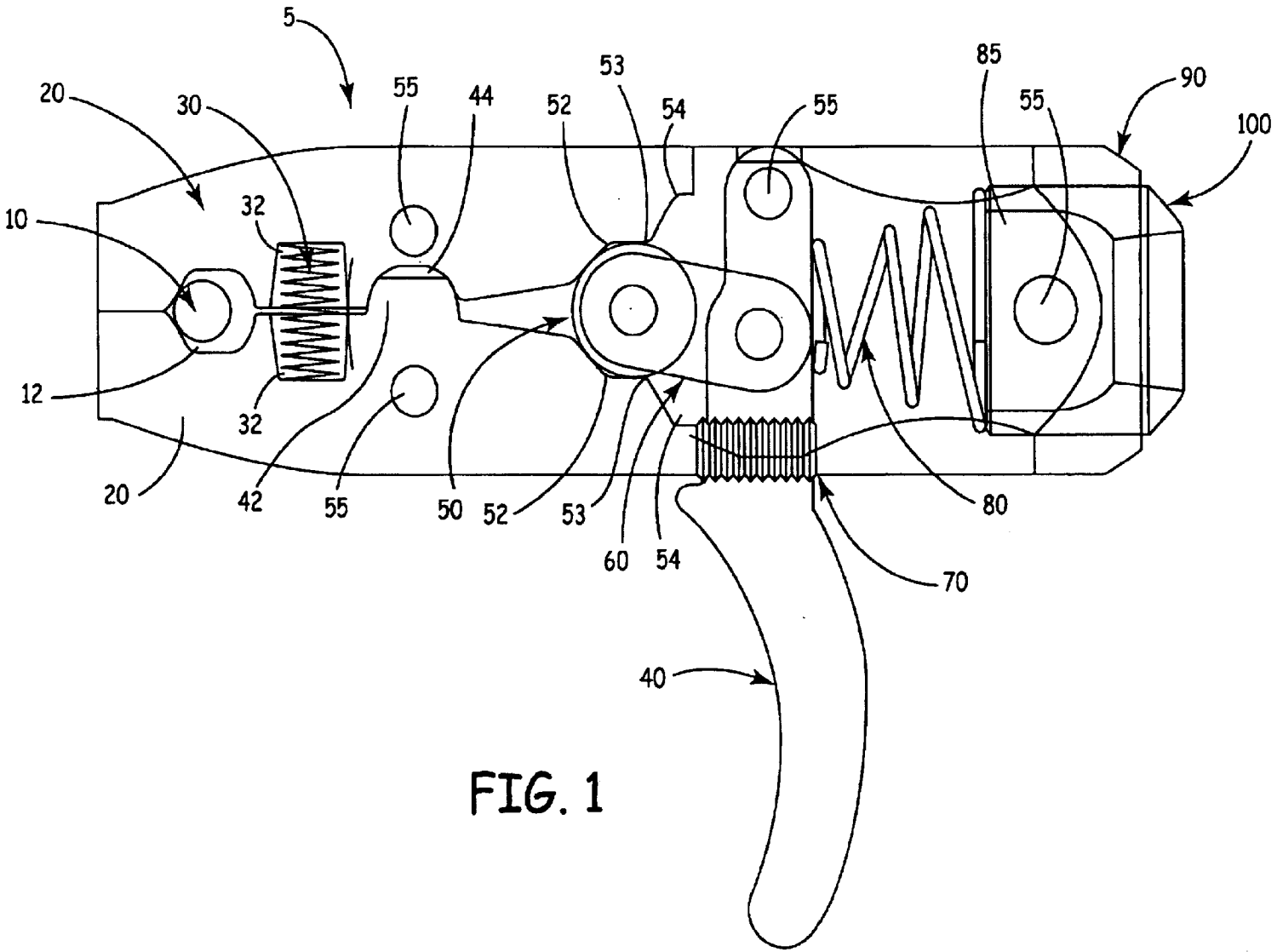
FIG. 1 is a cross-sectional view, with portions broken away, of a bow string release in a closed condition.

The string release of the present invention is shown on in FIG. 1 and is designated generally by the numeral 5. The release includes a body or housing which carries the trigger mechanism and a head.

The bow string release 5 of the present invention has been found to perform extremely advantageously when compared to releases such as a commercial embodiment of what is disclosed in U.S. Pat. No. 5,680,851 to Summers.

As shown in Table 1 and Chart 1 below, it has been found that prior art bow string releases, such as the commercial embodiment of U.S. Pat. No. 5,680,851 to Summers, "load up" severely as pulling force on the bow string is increased. "Loading up" is a phenomenon whereby the force required of the archer to pull the trigger and release the bow string increases as the effective draw weight of the bow increases. "Loading up" is not desirable because of the detrimental effects described previously, including detrimental effects on arrow accuracy and release durability.

TABLE 1

| | Effective Draw Weight (in pounds) | | | | | | |
|---|---|---|---|---|---|---|---|
| | 0 | 15 | 25 | 30 | 40 | 50 | 100 |
| Trigger Force Required to Release Jaws (in ounces) | | | | | | | |
| Commercial embodiment of U.S. Pat. No. 5,680,851 to Summers out of the box | 8 | 21 | 32 | 34 | 46 | >50 | >50 |
| Commercial embodiment of U.S. Pat. No. 5,680,851 to Summers (lightest adjustment) | 9 | 10 | 14 | 12 | 18 | >50 | >50 |
| Present Invention at average setting | 3.5 | 6.2 | 9.8 | 12 | 14 | 18 | 50 |
| Present Invention at lightest setting | 3 | 5.5 | 5.6 | 5.9 | 9.2 | 9.3 | 19.8 |

CHART 1

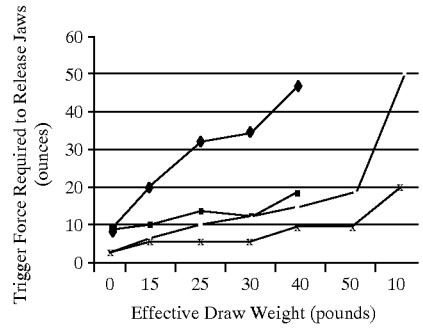

Commercial embodiment of U.S. Pat. No. 5,680,851 to Summers out of the box
Commercial embodiment of U.S. Pat. No. 5,680,851 to Summers (lightest adjustment)
Present Invention at average setting
Present Invention at lightest setting In contrast to prior art releases, the release 5 of the present invention requires a trigger pull force of less than fifty ounces, even less than ten ounces to separate jaws 20 of the release 5, even at an effective draw weight of one hundred pounds.

Referring now to FIG. 1, the release 5 is shown with a body or housing 90, which is a well known component in the art and can vary widely. The housing 90 is shown with most portions cut away to simplify the description of the mechanical components of the present invention that ordinarily, but not necessarily reside with the housing 90.

The release 5 is shown in FIG. 1 in a closed or string retaining position, shown holding string 10, which can be a bow string, a receiver, a rope loop, or any other object desired to be released. A string retaining void 12 is provided as opposing openings on two opposing jaws 20 to receive the string 10.

When an archer pulls on a trigger 40, jaws 20 are separated at a portion of the jaws 20 closest to the string 10. The mechanism that separates the jaws 20, and also keeps the jaws 20 together at rest at the portion of the jaws 20 closest to the string 10, is a cooperation between components in the release 5, as will be described fully below.

The trigger 40 is coupled to an axle link 60, in turn coupled to a jaw roller 50. At rest, a reset spring 80 urges the trigger 40, and in turn the axle link 60 and the jaw roller 50, towards the string 10. The reset spring 80 is placed between the trigger 40 and a reset spring support 85.

It should be noted that although we have chosen to call the jaw roller 50 a roller, the jaw roller 50 may not roll at all in the present embodiment because the jaw roller 50 is being acted upon equally but in opposite directions by both jaws 20. Instead of rolling, the jaw roller 50 provides a surface for which the jaws 20, and particularly the portion of the jaws 20 nearest to the closed condition roller receiver 52, roller receiver ridges 53, and the open condition roller receivers 54, to slide along during rotation of the jaws 20 between open and closed positions, and also during travel of the jaw roller 50 away from the string 10.

The jaw roller 50 is preferably a cylindrical body to decrease friction, although a wide variety of other forms could also perform suitably, such as but not limited to spherical elements such as ball bearings, non-spherical elements, or non-rotating members. For the purpose of defining the claims, although a roller is referred to, a roller is a surface for which the jaws 20, roller receiver ridges 53, and the open condition roller receivers 54, slide along during rotation of the jaws 20 between open and closed positions.

At rest, the jaw roller 50 is urged to contact and reside at least partially within a pair of opposing closed condition roller receivers 52. The closed condition roller receivers 52 are surfaces on interior portions of opposing jaws 20.

At rest, a portion of the jaws 20 furthest away from the string 10, the jaws are pushed away from each other by the jaw roller 50. This urges the jaws 20 to remain closed at the portion of the jaws 20 closest to the string 10.

A pin 55 is provided to couple the trigger 40 with the body 90, and also to provide a pivot point about which the trigger 40 is allowed to rotate during pulling of the trigger 40 and during return of the trigger 40 to the at rest position. Similar pins 55 are provided to couple the jaws 20 to the body 90, and also to provide a pivot point about which the jaws 20 are allowed to rotate.

A jaw spring 30 is provided between jaws 20 to urge the jaws 20 apart at a portion of the jaws 20 closest to the string 10 when it is desired to separate open the jaws 20, as will be discussed later. The jaw spring 30 is retained between jaws 20 in opposing jaw spring receivers 32 provided on the jaws.

A preferable construction detail of the jaws 20 is that the jaws are provided with a tab 42 and a socket 44 as shown. A similar tab and socket arrangement is fully described in U.S. Pat. No. 5,357,939 which is incorporated herein by reference. The tab 42 and socket 44 of the present invention synchronize the jaws by providing contact points between pins 55 that couple the jaws 20 with the body 90. This tab 42 and socket 44 arrangement prevents jaws 20 from undesirable swiveling motion during release 5 operation. Each opposing jaw 20 preferably has a tab 42, that can fit within a socket 44 on the opposing jaw. Independent ball bearing elements would also prevent the swiveling motion.

An adapter 100 is provided to couple the release 5 to other components that are not shown, such as a shaft or a release body structure. For example, but not by way of limitation, release body structures comprise hand-held or wrist strap style releases, such as a Tru-Fire BearPaw® release, a release known commercially as Winn Free Flight release, a Cobra Armstrong type glove, wrist strap styles such as used on a Tru-Fire Storm release (not shown) or a strap described in U.S. Pat. No. 4,831,997 to Greene, and hand-held styles (not shown). The release 5 of the present invention may be attached to any structure by any means, and the means for securing the release 5 to other components is not a part of the present invention.

Figure 2:
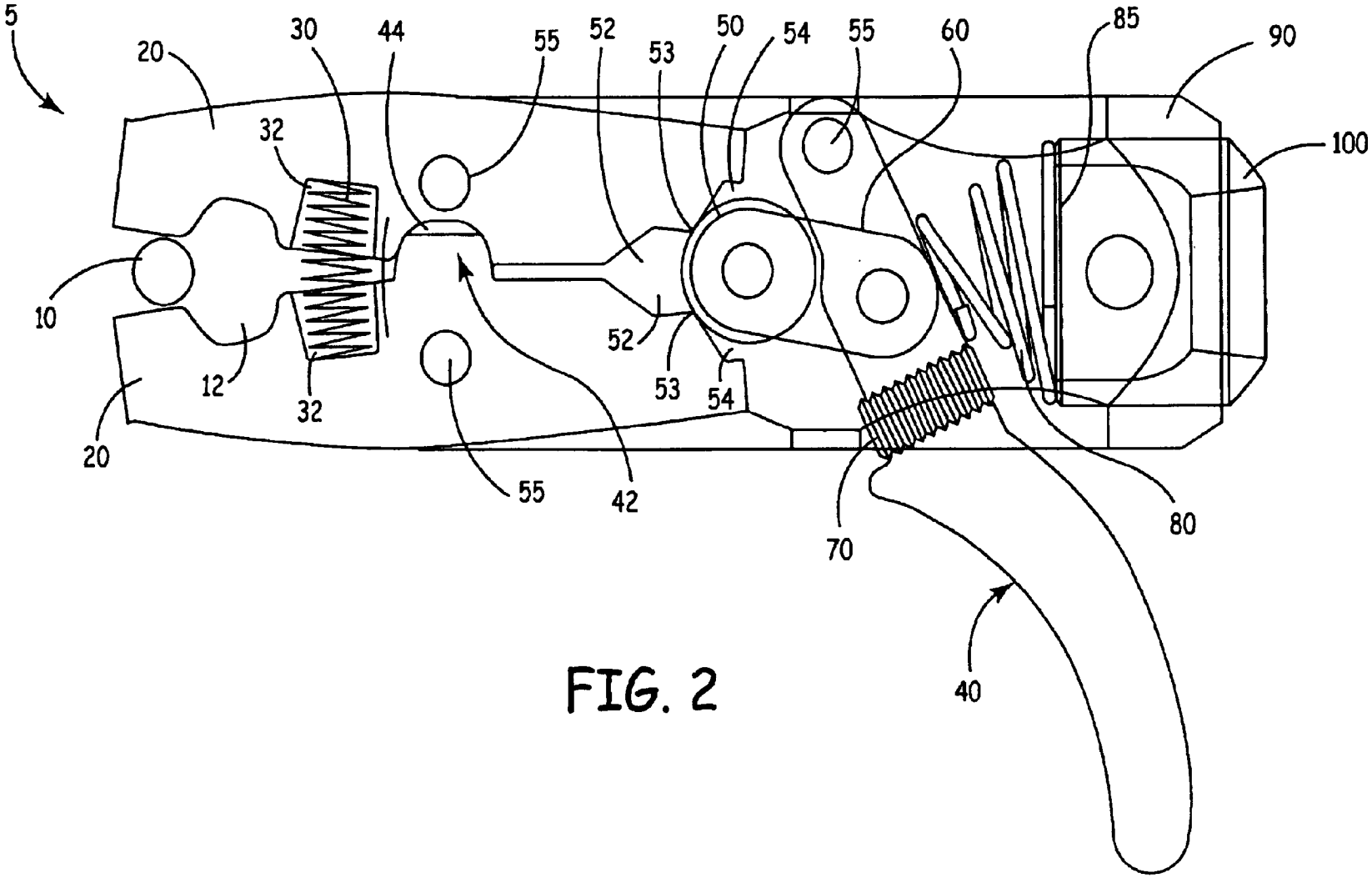
FIG. 2 is a cross-sectional view, with portions broken away, of a bow string release in an open condition.

Referring now to FIG. 2, the release 5 is shown in an open or string releasing position, shown with string 10 not gripped by the jaws 20.

To either engage the string 10 or release the string 10, an archer pulls on the trigger 40. When the trigger 40 is pulled, the trigger 40 draws the axle link 60 and the jaw roller 50 away from the string 10, and also compresses the reset spring 80. The trigger 40 is rotated around an axis pin 55, the use of which to secure components in a bow string release is well known. When the trigger 40 is pulled away from the string 10, the axle link 60 and the jaw roller 50 travel generally away from the string 10, allowing the jaw roller 50 to slide past a roller receiver ridge 53 that separates the closed condition roller receivers 52 from opposing open condition roller receivers 54.

Roughly simultaneously, the jaw spring 30 urges the jaws 20 to open closest to the string 10 in the open or string releasing position.

Figure 3:
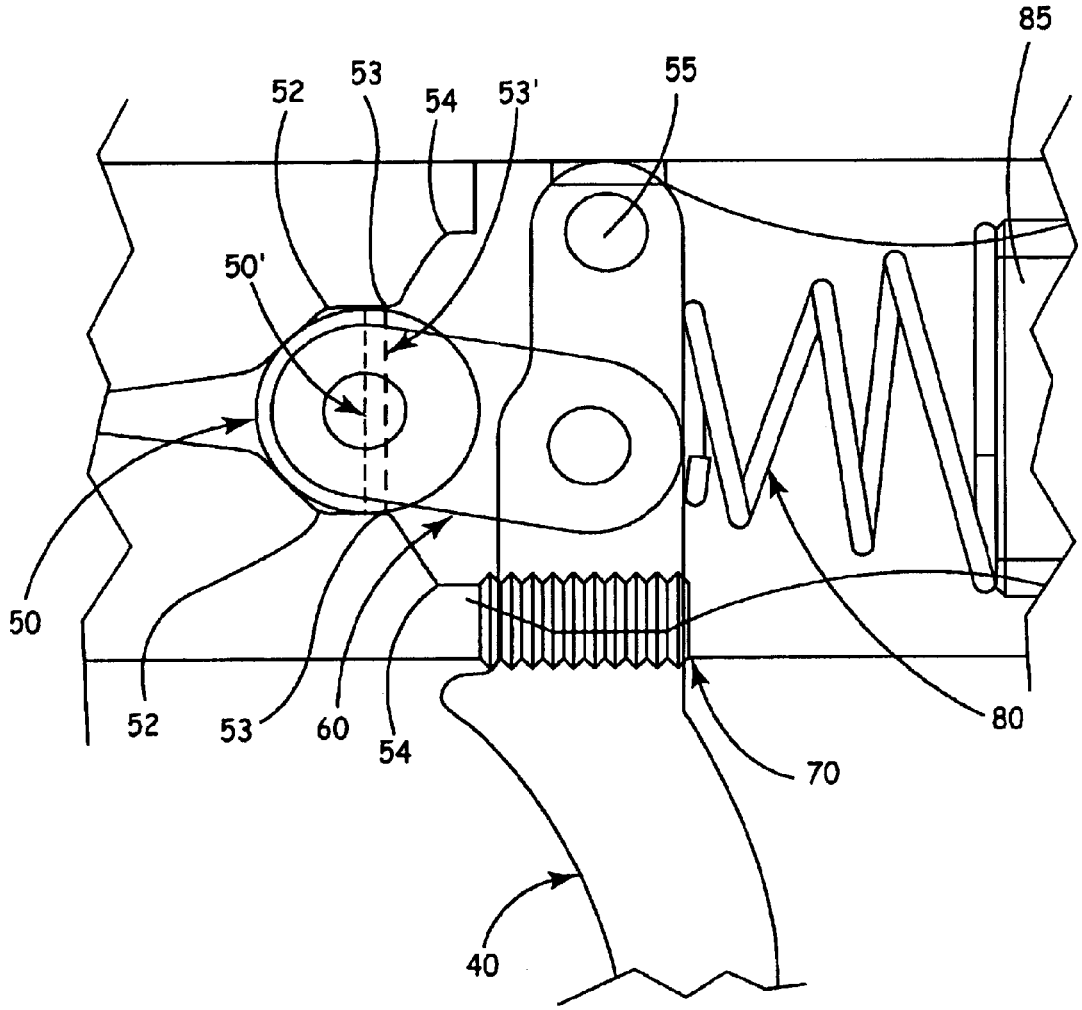
FIG. 3 is a cross-sectional view, with portions broken away, of a bow string release.

Referring now to FIG. 3, it is preferable to provide a trigger sensitivity adjustment screw 70 on the release 5 in order to allow archers to increase or decrease the trigger force, and/or trigger travel distance required to release the jaws 20. The screw 70 passes through a threaded void (not shown) in the trigger 40.

In a preferable commercial construction detail, the screw 70 is tightened with a small socket wrench by accessing a socket head (not shown) carried by the screw 70 toward the frontward (or left end when viewing FIG. 3) portion of screw 70.

In this embodiment, an archer can tighten or loosen the screw 70 when the trigger 40 is in the open, string releasing condition. The screw abuts against a portion of the jaw 20. By loosening the screw 70, more of the screw 70 becomes exposed toward the frontward portion of the screw 70, decreasing the trigger travel distance. By tightening the screw 70, less of the screw 70 is exposed, increasing the trigger travel distance.

An imaginary line is drawn between roller receiver ridges 53, and designated as line 53'. Also shown is a centerline of jaw roller 50, designated as centerline 50'. The distance between 50' and 53' is designated as the engagement distance. In a commercially preferable embodiment, a construction detail of the engagement distance is that the maximum engagement distance is 0.014".

If the screw 70 is fully tightened, the engagement distance is the greatest. The distance that an archer must pull the trigger 40 rearward (to the right when viewing FIG. 3), also referred to as trigger travel distance, is maximized. If the screw 70 is loosened, the engagement distance can be minimized, and the lighter trigger settings shorter trigger travel distances are achieved. In the fully loosened screw 70 position, trigger travel distance is minimized, with a commercially preferable minimum of just slightly greater than 0".

When an archer pulls on the trigger 40 and pulls centerline 50' past line 53' (rearward, or to the right when viewing FIG. 3), the jaw roller 50 slides down into the open condition roller receiver 54.

Figure 4:
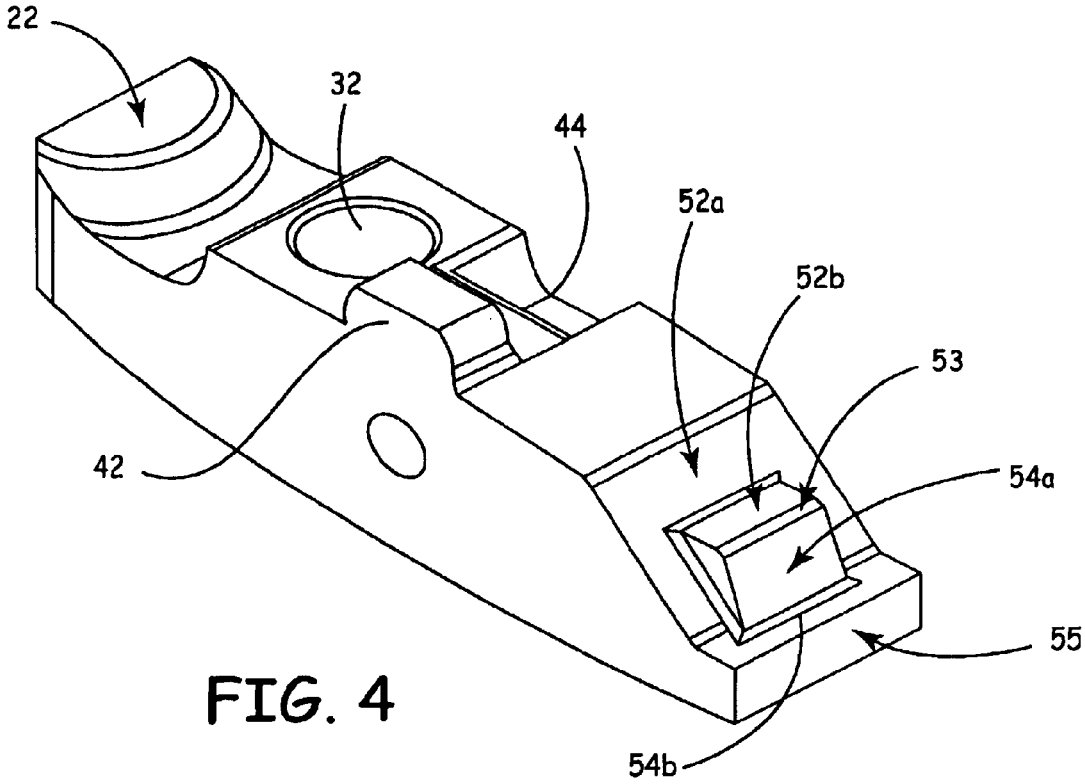
FIG. 4 is an orthogonal view of a caliper jaw.

Referring now to FIG. 4, an orthogonal view of a single jaw 20 is shown, although it is understood that two similar opposing jaws 20 are employed on the release 5, with similar mirroring structure. The opposing jaws preferably each have a opposing tab 42, that can fit within a opposing socket 44 on the opposing jaw. Also preferably, each opposing jaw 20 has a face surface 22, although any suitable string retaining arrangement could be used.

Preferably, closed condition roller receivers 52 as shown on FIGS. 1–3 are formed by closed condition roller receiver angle surface **52*a* and closed condition roller receiver parallel surface 52*b* as shown on FIG. 4. Also preferably, open condition roller receivers 54 as shown on FIGS. 1–3 are formed by open condition roller receiver angle surface 54*a* and open condition roller receiver parallel surface 54*b* as shown on FIG. 4. Open condition roller receiver angle surface 54*a*, in conjunction with spring 30 and reset spring 80 (shown in FIGS. 1–3) maintain constant contact with the roller 50** during firing, preventing undesirable clicking and minimizing component wear.

It should be noted that the open condition roller receivers angle surface **54*a* form a relatively steep slope to slide about the jaw roller 50, compared to a relatively parallel relationship formed by the closed condition roller receiver parallel surfaces 52*b***. Although we have referred to some surfaces as parallel, parallelism is not required, it is a preferred relationship for ease of fabrication.

A sensitivity screw abutting surface 55 is provided for either the screw 70 or the trigger 40 (shown in FIGS. 1–3) to rest against.

Roller receiver ridge 53, shown in FIGS. 1–4, provides a transition between surfaces that maintain closed string retaining condition and open string releasing condition. A preferred embodiment of roller receiver ridge 53 has a small radius, although a sharp edge would also perform suitably.

Turning to materials used to construct the components of the release 5, it has been found that a decrease in friction between components such as the roller 50 and jaws 20 minimizes wear. By providing frictionally compatible materials between components of the release, wear is minimized, which is advantageous to long term function of the release 5.

One approach to decreasing friction and minimizing wear is to use like material to construct both the roller 50 and jaws 20. Like materials that are frictionally compatible and perform suitably are steel to construct both the roller 50 and jaws 20. The coefficient of rolling friction for steel on steel or iron on iron is reported as 0.02, a highly acceptable level.

Another approach to decreasing friction and minimizing wear is to use material to construct both the roller 50 and jaws 20 that possess low coefficients of static friction. For example, Teflon® coated material may have coefficients of static friction as low as 0.04, again a highly acceptable level for a frictionally compatible material.

The foregoing disclosure and description of the invention are illustrative and explanatory thereof, and various changes in the size, shape and materials, and components, as well as in the details of the illustrated construction may be made without departing from the spirit of the invention.

What is claimed is:

1. A bow string release for engaging and releasing a bow string, comprising:

opposing jaws;

a trigger;

a jaw roller moveable between a forward position closest to the bow string, and a back position;

the jaw roller coupled to the trigger and slidably engaged with the opposing jaws and allowing the opposing jaws to move between a closed position when said jaw roller is in position to an open position when said jaw roller is in said back position.

2. A bow string release according to claim 1, the release further comprising an axle link coupled between the trigger and the jaw roller.

3. A bow string release according to claim 1, the release further comprising a reset spring biased to urge the trigger to urge the roller to urge the jaws to the closed position.

4. A bow string release according to claim 1, the release further comprising a jaw spring retained between the opposing jaws that urges the opposing jaws to the open position when the trigger is pulled.

5. A bow string release according to claim 1, the opposing jaws each having a jaw spring receiver for carrying the spring.

6. A bow string release according to claim 1, the jaw roller further allowing the opposing jaws to the closed condition when the trigger is released from the pulled position.

7. A bow string release according to claim 1, the release further comprising a means for adjusting a pull force required to pull the trigger to the pull position.

8. A bow string release according to claim 7, wherein the pull force is adjustable to less than 9 ounces at an effective draw weight of 15 pounds.

9. A bow string release according to claim 1, the release further comprising an trigger sensitivity adjustable screw coupled to the trigger and allowing for trigger sensitivity adjustment.

10. A bow string release according to claim 9, wherein the trigger sensitivity adjustment is adjustable to less than 9 ounces at an effective draw weight of 15 pounds.

11. A bow string release according to claim 9, wherein a loosening of the trigger sensitivity adjustable screw decreases a distance that the trigger must travel to release the bow string.

12. A bow string release according to claim 1, the release further comprising:

a housing;

a pin, the pin coupling the trigger to the housing.

13. A bow string release according to claim 1, the release further comprising a plurality of jaw pins, the jaw pins coupling the opposing jaws to a housing.

14. A bow string release according to claim 1, at least one of the opposing jaws comprising:

a closed condition roller receiver adapted to receive the jaw roller in the closed condition;

a roller receiver ridge;

an open condition roller receiver adapted to receive the jaw roller in the open position; said roller receiver ridge positioned between said closed condition roller receiver and open closed condition roller receiver.

15. A bow string release according to claim 14, wherein the closed condition roller receiver is formed by a closed condition roller receiver forward angled surface and a closed condition roller receiver substantially parallel surface.

16. A bow string release for engaging and releasing a bow string, the bow string release adapted to release the bow string by pulling a trigger with a pull force of equal to or less than 40 ounces when an effective draw weight of the bow is equal to or more than 50 pounds.

17. A bow string release for engaging and releasing a bow string, the bow string release adapted to release the bow string by pulling a trigger with a pull force of equal to or less than 30 ounces when an effective draw weight of the bow is equal to or more than 50 pounds.

18. A bow string release for engaging and releasing a bow string, the bow string release adapted to release the bow string by pulling a trigger with a pull force of equal to or less than 20 ounces when an effective draw weight of the bow is equal to or more than 50 pounds.

19. A bow string release for engaging and releasing a bow string, the bow string release adapted to release the bow string by pulling a trigger with a pull force of equal to or less than 10 ounces when an effective draw weight of the bow is equal to or more than 25 pounds.

20. A bow string release for engaging and releasing a bow string, the bow string release adapted to release the bow string by pulling a trigger with a pull force of equal to or less than 9 ounces when an effective draw weight of the bow is equal to or more than 15 pounds.

21. A bow string release for engaging and releasing a bow string, the bow string release adapted to release the bow string by pulling a trigger with a pull force of equal to or less than 8 ounces when an effective draw weight of the bow is equal to or more than 15 pounds.

22. A bow string release for engaging and releasing a bow string, the bow string release adapted to release the bow string by pulling a trigger with a pull force of equal to or less than 7 ounces when an effective draw weight of the bow is equal to or more than 15 pounds.

23. A bow string release for engaging and releasing a bow string, the bow string release adapted to release the bow string by pulling a trigger with a pull force of equal to or less than 6 ounces when an effective draw weight of the bow is equal to or more than 15 pounds.

24. A method of releasing a bow string with a bow string release comprising:

grasping the bowstring with jaws carried by the bow string release;

engaging with a finger a trigger carried by the bow string release;

drawing the bow string back to a firing position;

creating an effective draw weight of the bow of equal to or more than 25 pounds;

pulling the trigger with the finger with a pull force of equal to or less than 10 ounces to release the bow string.

25. A method of releasing a bow string with a bow string release comprising:

grasping the bowstring with jaws carried by the bow string release;

engaging with a finger a trigger carried by the bow string release;

drawing the bow string back to a firing position;

creating an effective draw weight of the bow of equal to or more than 15 pounds;

pulling the trigger with the finger with a pull force of equal to or less than 9 ounces to release the bow string.

26. A method of releasing a bow string with a bow string release comprising:

grasping the bowstring with jaws carried by the bow string release;

engaging with a finger a trigger carried by the bow string release;

drawing the bow string back to a firing position;

creating an effective draw weight of the bow of equal to or more than 15 pounds;

pulling the trigger with the finger with a pull force of equal to or less than 8 ounces to release the bow string.

27. A method of releasing a bow string with a bow string release comprising:

grasping the bowstring with jaws carried by the bow string release;

engaging with a finger a trigger carried by the bow string release;

drawing the bow string back to a firing position;

creating an effective draw weight of the bow of equal to or more than 15 pounds;

pulling the trigger with the finger with a pull force of equal to or less than 7 ounces to release the bow string.

28. A method of releasing a bow string with a bow string release comprising:

grasping the bowstring with jaws carried by the bow string release;

engaging with a finger a trigger carried by the bow string release;

drawing the bow string back to a firing position;

creating an effective draw weight of the bow of equal to or more than 15 pounds;

pulling the trigger with the finger with a pull force of equal to or less than 6 ounces to release the bow string.

29. A bow string release for engaging and releasing a bow string, comprising a roller and a pair of jaws, sliding engaging the roller whereby the jaws move between an open and closed position, the roller and the jaws both formed of like frictionally compatible materials.

30. A bow string release according to claim 29 wherein the roller and the jaws are formed of steel.

* * * * *